US012637854B2

(12) United States Patent
Rahman et al.

(10) Patent No.: US 12,637,854 B2
(45) Date of Patent: May 26, 2026

(54) NOTCHED MOMENT FRAME CONNECTOR SYSTEM

(71) Applicant: Simpson Strong-Tie Company Inc., Pleasanton, CA (US)

(72) Inventors: Fayad Rahman, Oakland, CA (US); Brandon Y. Chi, Oakland, CA (US)

(73) Assignee: Simpson Strong-Tie Company Inc., Pleasanton, CA (US)

( * ) Notice: Subject to any disclaimer, the term of this patent is extended or adjusted under 35 U.S.C. 154(b) by 202 days.

(21) Appl. No.: 18/481,626

(22) Filed: Oct. 5, 2023

(65) Prior Publication Data

US 2025/0116105 A1 Apr. 10, 2025

(51) Int. Cl.
*E04B 1/24* (2006.01)

(52) U.S. Cl.
CPC .... *E04B 1/2403* (2013.01); *E04B 2001/2415* (2013.01); *E04B 2001/2418* (2013.01); *E04B 2001/2448* (2013.01); *E04B 2001/2457* (2013.01); *E04B 2001/2496* (2013.01)

(58) Field of Classification Search
CPC ..... E04B 1/2403; E04B 2001/2415; E04B 2001/2418; E04B 2001/2448; E04B 2001/2442; E04B 2001/2496; E04B 2001/2457
See application file for complete search history.

(56) References Cited

U.S. PATENT DOCUMENTS

| | | | | |
|---|---|---|---|---|
| 1,744,600 | A * | 1/1930 | Wilcox | E04B 1/2403 403/230 |
| 3,938,297 | A * | 2/1976 | Sato | F16B 9/052 403/189 |
| 12,359,421 | B1 * | 7/2025 | Alrubaidi | E04B 1/2403 |
| 2022/0259844 | A1 * | 8/2022 | Pryor | E04C 3/11 |
| 2024/0337099 | A1 * | 10/2024 | Boyd | E04B 1/2403 |

FOREIGN PATENT DOCUMENTS

| | | | | |
|---|---|---|---|---|
| CN | 107355002 | | 11/2017 | |
| CN | 107355002 | B * | 9/2023 | E04B 1/2403 |
| DE | 1904738 | | 8/1970 | |
| DE | 10140878 | | 3/2003 | |
| EP | 2292856 | | 12/2014 | |

OTHER PUBLICATIONS

English language Abstract for DE10140878 published Mar. 6, 2003.
English language Abstract for CN107355002 published Nov. 17, 2017.
International Search Report and Written Opinion dated Jan. 24, 2025 in International Patent Application No. PCT/US2024/049417.

* cited by examiner

*Primary Examiner* — Brent W Herring
(74) *Attorney, Agent, or Firm* — Pearl Cohen Zedek Latzer Baratz LLP

(57) ABSTRACT

A high strength moment frame connector system is used to connect beams and columns. The moment frame connector system includes a shear tab connected between the column and beam, and a pair of T-shaped connectors connected between the column and beam. Each T-shaped connector includes a first section affixed to the column and a second section affixed to upper and lower flanges of the beam. The first section includes a notch to prevent interference between the T-shaped connector, the shear tab and/or bolted connections for those components.

28 Claims, 16 Drawing Sheets

(Line A-A)

NOTCHED MOMENT FRAME CONNECTOR SYSTEM

BACKGROUND

Field of the Technology

The present invention relates to a moment frame connector system designed to connect a beam to a column in constructions, and in particular to a high strength moment frame connector system effective in resisting high winds and other lateral loads.

Description of the Related Art

Lateral loads due to natural phenomena such as high winds can have devastating effects on the structural integrity of buildings, bridges and other constructions. Lateral forces generated during such natural phenomena may cause the top portion of a wall to move laterally with respect to the bottom portion of the wall, which movement can result in damage or structural failure of the wall and, in some instances, collapse of the building. One of the critical components in the structural framework of buildings is the connection between beams and columns. In conventional construction, this connection is achieved through various methods such as welding, bolting, or adhesive bonding. While these methods are effective in moderate conditions, they often fall short in high wind areas, where the large forces acting on the structure can lead to joint failure, compromising the structural integrity of the entire building. The stiffness of these connections are also important to the behavior of the lateral system and in protecting architectural components.

One method of providing a high-strength connection effective at resisting lateral loads is to increase the size of the beam; that is, to increase the height of the web section between the upper and lower flanges. However, increasing the size of beams is problematic as the vertical space available for such beams is at a premium, and structural engineers designing such constructions would prefer to work with standard sized beams and columns.

It is also known to provide T-shaped connectors including vertical sections affixed to the column and horizontal sections affixed to the top and bottom flanges of the beam. FIG. 1 is a side view of a section of a conventional moment frame including a column 50 connected to a beam 52 by a pair of T-shaped connectors 54. The moment frame further includes a shear tab 56. Increasing the size of the T-shaped connector and/or shear tab would be effective at resisting high winds and lateral loads. However, the T-shaped connectors must fit within the space between the top and bottom flanges of standard sized beams without interference with the shear tab. As noted above, this space is limited.

Another consideration unrelated to loading of structures is the ease and effectiveness with which such structures may be erected by crews at a worksite. One task which adds to the time, complexity and cost of constructions is having to weld components together at the worksite. Bolted connections are typically preferred, in that they may be accomplished more quickly, effectively and without the additional equipment and labor costs associated with welding.

SUMMARY OF THE TECHNOLOGY

The present technology relates to a high strength moment frame connector system which operates with beams and columns of standard dimensions. The moment frame connector system includes a shear tab connected between the column and beam, and a pair of T-shaped connectors connected between the column and beam. Each T-shaped connector, referred to herein as a T-plate, includes a vertical section affixed to the column and a horizontal section affixed to upper and lower flanges of the beam. In accordance with aspects of the present technology, the vertical and/or horizontal sections of each T-plate may be made long and thick to withstand high winds and other large lateral loads. In order to allow the vertical section of each T-plate to be made long and thick without impinging on the space used for the shear tab, a notch may be provided within the vertical sections of one or both T-plates. The bolts connecting the beam to the column are also important to the strength and stiffness of the connection. In order to fit larger bolts to a T-plate connection, the vertical sections would need to be long and thick. The notches in accordance with the present technology also allow for the use of larger bolts, without impinging on the space used for the shear tab.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the Background.

DETAILED DESCRIPTION

Figure 1:
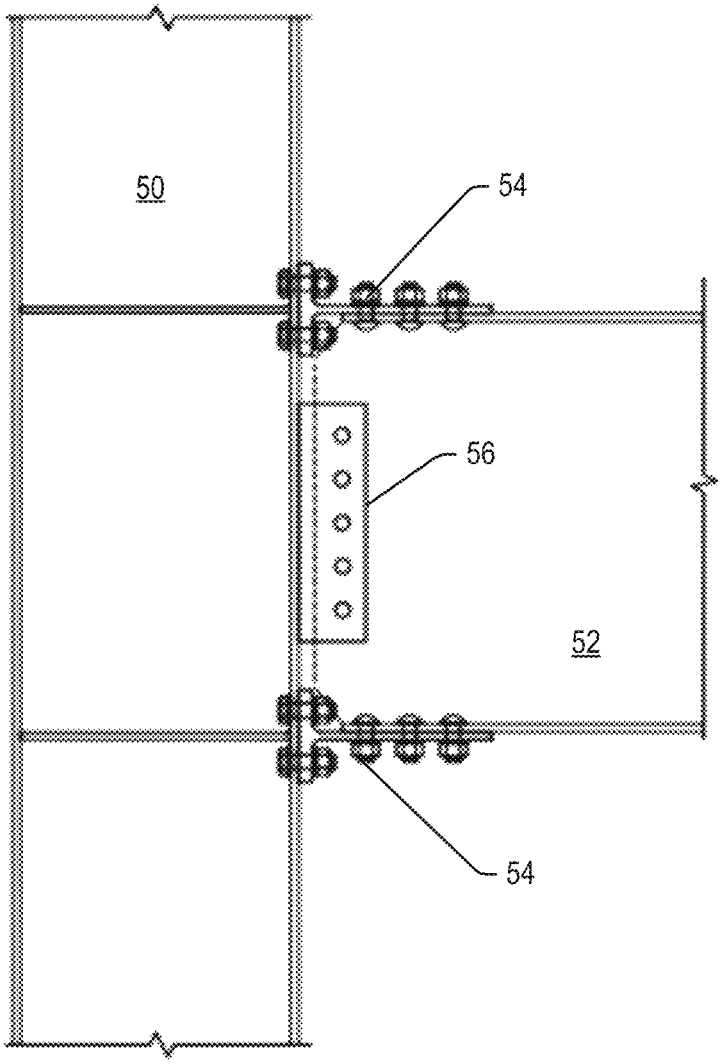
Fig. 1 (Prior Art)
FIG. 1 is a prior art side view of a moment frame connection including a beam and column.

The present technology will now be described with reference to the figures, which in embodiments relate to a high strength moment frame connection system which works with beams and columns of standard dimensions. In embodiments, the moment frame includes a beam having a central web affixed to top and bottom flanges, and a column having a central web affixed to inner and outer flanges. The moment frame connector includes a shear tab affixed to the inner flange of the column as by welding, and to the central web of the beam as by bolts. The moment frame connector further includes a pair of T-shaped connectors, referred to herein as T-plates, each having a vertical plate integrally formed or otherwise connected to a horizontal plate. An upper T-plate has its vertical plate affixed to the inner flange of the column as by bolts, and has its horizontal plate affixed to the upper flange of the beam as by bolts. A lower T-plate has its vertical plate affixed to the inner flange of the column as by bolts, and has its horizontal plate affixed to the lower flange of the beam as by bolts.

In certain applications, it is desirable to increase the strength of the moment frame connector by increasing the size of the shear tab. T-plates and/or the bolts for those components. In accordance with the present technology, this may be accomplished by forming a notch in the vertical plates of the upper and lower T-plates. This allows the size of the shear tab, T-plates and/or bolts to be increased without interfering with the position of the shear tab. These notches also allow different T-plates to be used as needed for a particular project, while working with standard beams, columns and shear tabs.

It is understood that the present technology may be embodied in many different forms and should not be construed as being limited to the embodiments set forth herein; rather these embodiments are provided so that this disclosure will be thorough and complete and will fully convey the technology to those skilled in the art. Indeed, the technology is intended to cover alternatives, modifications and equivalents of these embodiments, which are included within the scope and spirit of the technology as defined by the appended claims. Furthermore, in the following detailed description of the present technology, numerous specific details are set forth in order to provide a thorough understanding of the present technology. However, it will be clear to those of ordinary skill in the art that the present technology may be practiced without such specific details.

The terms "top" and "bottom," "upper" and "lower" and "vertical" and "horizontal," and forms thereof, as may be used herein are by way of example and illustrative purposes only, and are not meant to limit the description of the technology inasmuch as the referenced item can be exchanged in position and orientation. Also, as used herein, the terms "substantially" and/or "about" mean that the specified dimension or parameter may be varied within an acceptable manufacturing tolerance for a given application. In one embodiment, the acceptable manufacturing tolerance is ±0.15 mm, or alternatively, ±2.5% of a given dimension.

For purposes of this disclosure, a connection may be a direct connection or an indirect connection (e.g., via one or more other parts). In some cases, when a first element is referred to as being connected, affixed, mounted or coupled to a second element, the first and second elements may be directly connected, affixed, mounted or coupled to each other or indirectly connected, affixed, mounted or coupled to each other. When a first element is referred to as being directly connected, affixed, mounted or coupled to a second element, then there are no intervening elements between the first and second elements (other than possibly an adhesive or melted metal used to connect, affix, mount or couple the first and second elements).

Figure 2:
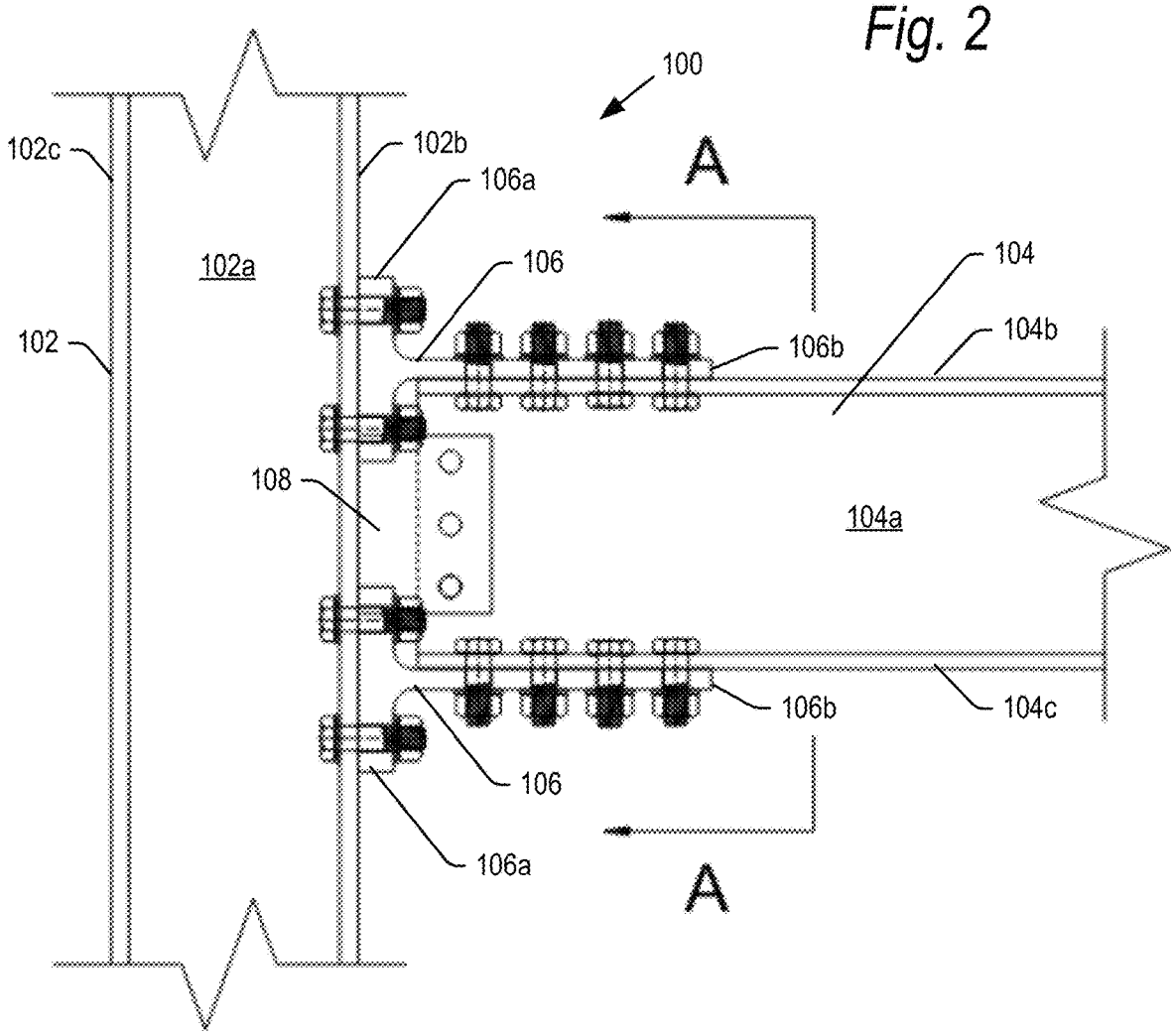
FIG. 2 is a side view of a moment frame connection including a beam, column and a pair of T-plate connectors according to embodiments of the present technology.

FIG. 2 is a side view of a moment frame connector system 100 according to the present technology including a column 102 and a beam 104, each of which may be structural steel such as an I-beam, a wide-flange I-beam or a standard structural W-beam. The column 102 includes a central web 102*a*, and inner and outer flanges 102*b*, 102*c*. The beam 104 includes a central web 104*a*, and top and bottom flanges 104*b*, 104*c*. In one example, the column 102 may have a depth (between the surfaces of the inner and outer flanges) of between 15 inches to 22 inches, though this dimension may vary outside of that range in further embodiments. In an example, the column 102 may have a width (of the flanges) of between 5 inches and 12 inches, though this dimension may vary outside of that range in further embodiments. In one example, the beam 104 may have a width (from the top of the top flange to the bottom of the bottom flange) of between 15 inches to 22 inches, though this dimension may vary outside of that range in further embodiments. In an example, the beam 104 may have a depth (width of the flanges) of between 5 inches and 12 inches, though this dimension may vary outside of that range in further embodiments.

In one example, each of the webs 102*a*, 104*a* of the beam and column may have a thickness of 1 inch, ¾ inch or ½ inch, though the thicknesses of the webs 102*a*. 104*a* may vary in further embodiments and need not be the same as each other. In one example, each of the flanges 102*b*, 102*c*. 104*b*, 104*c* of the beam and column may have a thickness of 1 inch, though the thicknesses of the flanges may vary in further embodiments and need not be the same as each other. Embodiments herein describe the column and beam as having an I-shaped cross-section. However, in further embodiments, at least the column may be hollow structural sections (HSS) tube steel with a square, rectangular or circular cross-section. Moreover, in embodiments, the column 102 and beam 104 are both monolithic structures. However, in further embodiments, the column 102 and/or beam 104 may be built up of discrete sections that are bolted, welded or otherwise affixed to each other.

The moment frame connector system 100 includes top and bottom T-plates 106 and a shear tab 108. The T-plates 106 are explained hereinafter. Shear tab 108 may be shipped to the construction site welded to inner flange 102*b* of column 102. Once at the construction site, the shear tab 108 may be bolted to the web 104*a* of beam 104. The shear tab 108 may be affixed to the column 102 and/or beam 104 by other methods in further embodiments. The dimensions of the shear tab 108 may vary, but in one example, the shear tab may have a length (between the flanges of the beam 104) of 10 inches to 18 inches, a width of 5 inches to 14 inches, and a thickness of ½ inch to 1 inch. Each of these dimensions may vary in further embodiments. The illustrated examples include three bolts to affix the shear tab 108 to the web 104*a* of beam 104, but there may be other numbers of bolts in further embodiments.

The top and bottom T-plates 106 will now be described with respect to the various views of FIGS. 2-7. While the following description refers to a single T-plate, the top and bottom T-plates 106 may be identical to each other, and the following description applies to both the top and bottom T-plates 106. In general, the T-plates 106 may be structural connectors including a first, or vertical, plate 106*a* and a second, or horizontal, plate 106*b*. The horizontal plate 106*b* may extend orthogonally from a midsection of the vertical plate 106*a*, dividing the vertical plate into first and second sections. However, use of the terms "vertical" and "horizontal" here refer to one embodiment where, upon installation onto the column and beam, the plate 106*a* is vertical and the plate 106*b* is horizontal. It is understood that the T-plate 106 including vertical plate 106*a* and horizontal plate 106*b* may be used in a variety of other orientations in further embodiments where the installed plates 106*a* and 106*b* are not vertical or horizontal.

In embodiments, the vertical and horizontal plates 106*a*. 106*b* may be formed integrally with each other, and may for example be cut from a single section of I-beam or W-beam. The vertical and horizontal plates 106*a*, 106*b* may be formed separately and affixed to each other as by welding in further embodiments. The vertical plate 106*a* may be affixed to inner flange 102*b* of column 102, as for example by bolts fitting through bolt holes 112. The horizontal plate 106*b* of the top T-plate 106 may be affixed to the upper flange 104*b* of beam 104, as for example by bolts fitting through bolt holes 114. The horizontal plate 106*b* of the bottom T-plate 106 may be affixed to the lower flange 104*c* of beam 104, as for example by bolts fitting through bolt holes 114. Assembly of the T-plates 106 between the column 102 and beam 104 is explained in greater detail below with respect to FIGS. 8-11. The number of bolt holes 112 and bolt holes 114 is shown by example only, and there may be greater or fewer bolt holes 112, 114 in further embodiments.

In accordance with aspects of the present technology, a notch 110 may be formed in the vertical plates 106*a* of the top and bottom T-plates 106. The notch 110 may be centered in the vertical plate 106*a* (left to right from the perspective of FIG. 4), between bolt holes 112. As seen for example in FIG. 3, the top T-plate 106 is assembled onto the column and beam so that the notch 110 faces downward, and the bottom T-plate 106 is assembled onto the column and beam so that the notch 110 faces upward. A purpose of the notches 110 in the pair of T-plates 106 is to receive the upper and lower edges of the shear tab 108 so that there is no interference between the T-plates 106 and shear tab 108, or the bolts used to affix these components. The notches 110 effectively allow use of larger T-plates 106, shear tab 108 and/or the bolts without interference between these components.

In embodiments, the sections of the vertical plate 106*a* extending above and below the horizontal plate are of equal length. However, in further embodiments, it is possible that one of these sections be longer than the other. In such embodiments, the notch 110 may be formed in the longer section or the shorter section.

Figure 4:
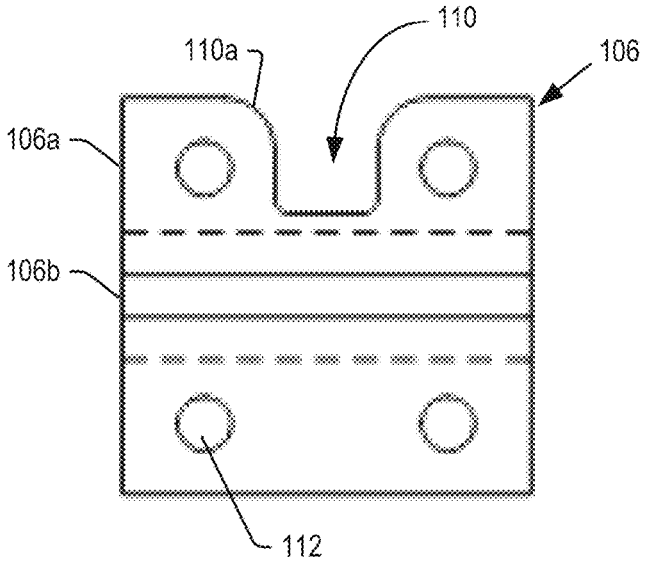
FIG. 4 is an end view of a T-plate according to embodiments of the present technology.
Figure 5:
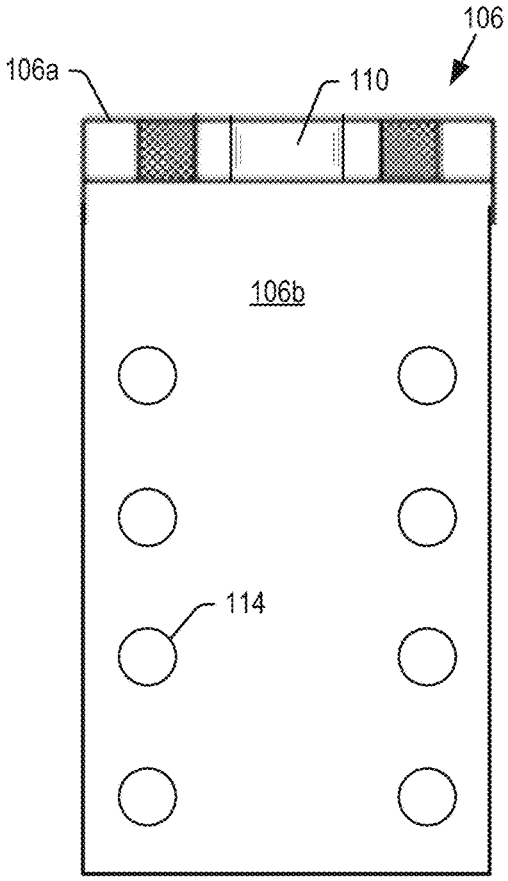
FIG. 5 is a top view of a T-plate according to embodiments of the present technology.
Figure 6:
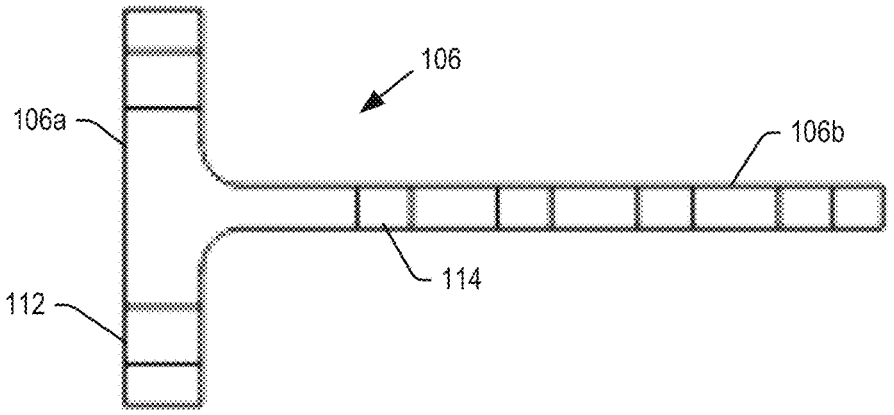
FIG. 6 is a side view of a T-plate according to embodiments of the present technology.
Figure 7:
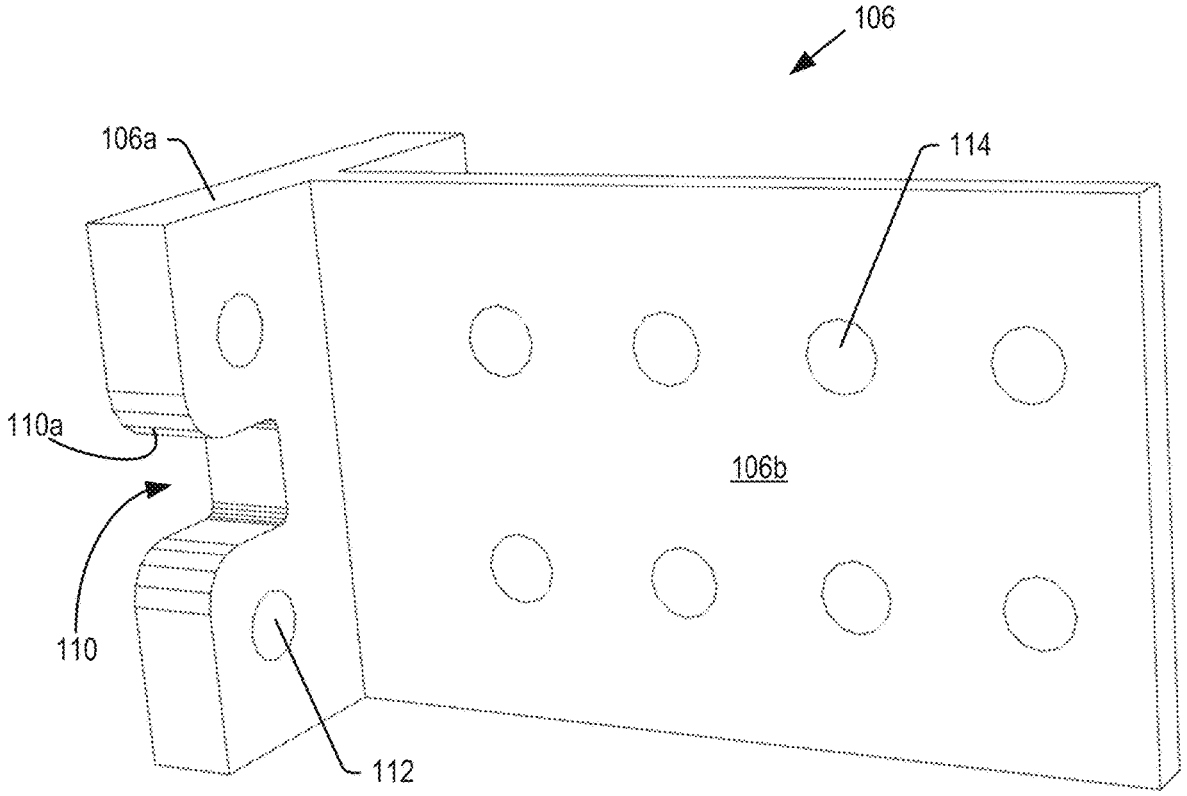
FIG. 7 is a perspective view of a T-plate according to embodiments of the present technology.
Figure 17:
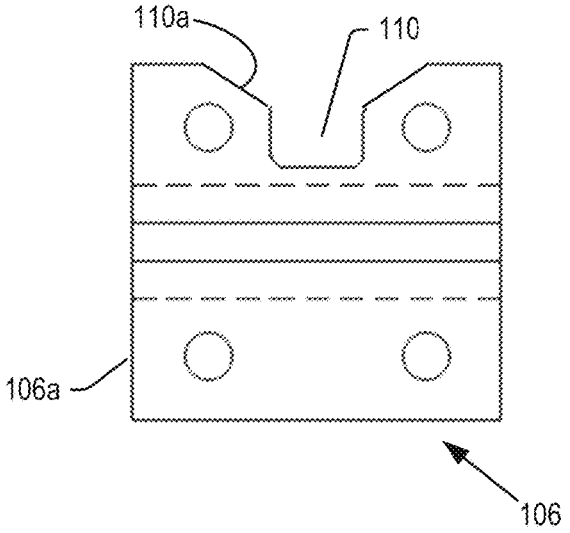

As seen for example in FIGS. 4 and 7, the notch 110 on both T-plates 106 may be formed with rounded leading edges 110*a*. As shown in FIG. 17 described below, these leading edges 110*a* may be sloped instead of rounded. The sloped or rounded edges may be omitted entirely in further embodiments. The notches 110 may be cut into the T-plates 106 by various methods including for example computer numeric control (CNC) plasma cutting. The PythonX robotic plasma cutting system by Burlington Automation Corp. of Ontario Canada is one example of such a cutting system. Other cutting methods such as by saw blade are possible.

Figure 8:
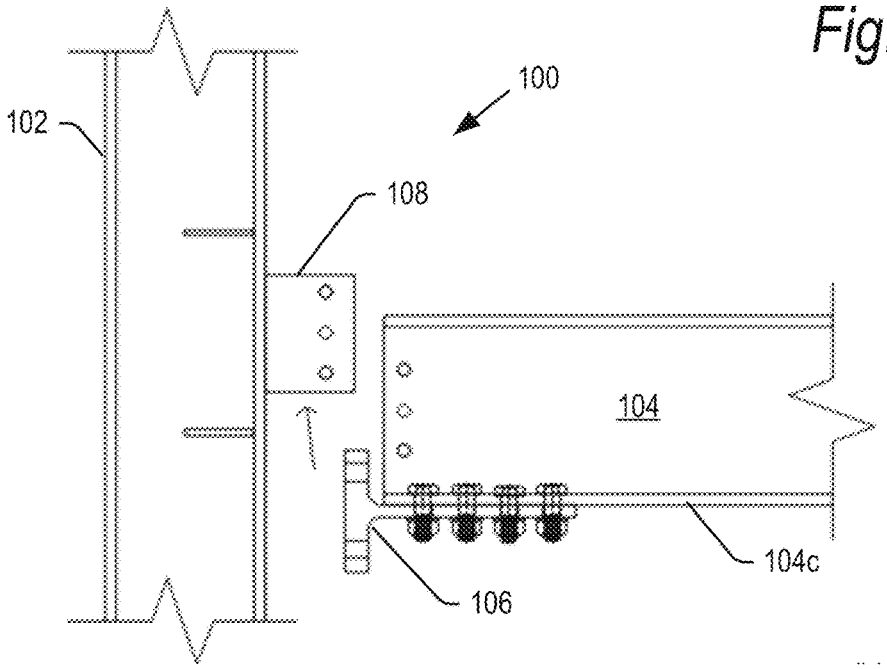
FIGS. 8 and 9 are side views showing a first method of assembling a beam onto a column according to embodiments of the present technology.
Figure 9:
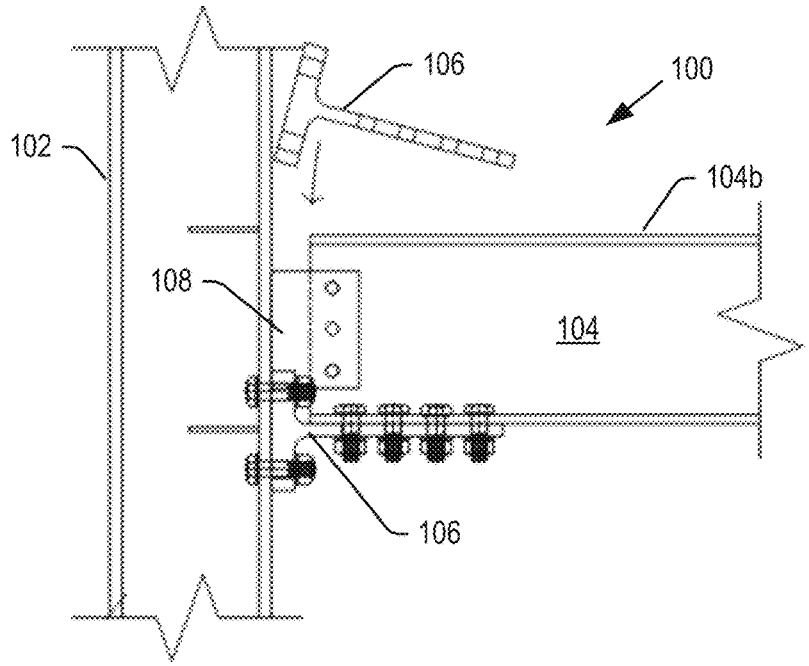

FIGS. 8 and 9 are side views of the moment frame and connector 100 showing a method of assembly. The column 102 may be shipped to a construction site with the shear tab 108 affixed thereto as by welding as described above. The bottom T-plate 106 may be affixed to bottom flange 104*c* of beam 104 either at the construction site or before arrival at the construction site. As shown in FIG. 8, the beam 104 may then be lifted into position from below the shear tab 108. The notch 110 in the lower T-plate 106 functions to position the beam 104 centered with respect to column 102 and shear tab 108. The leading edges 110*a* of notch 110 serve to correct any misalignment. The vertical plate 106*a* of the lower T-plate 106 may then be bolted to the inner flange 102*b* of column 102, and the shear tab 108 may be bolted to the web 104*a* of the column 104.

Thereafter, as shown in FIG. 9, the upper T-plate 106 may then be positioned, using the leading edges 110*a* of notch 110 to properly position the T-plate 106. The upper T-plate 106 may then be affixed by bolting the vertical plate 106*a* of the upper T-plate 106 to the inner flange 102*b* of column 102, and bolting the horizontal plate 106*b* of the upper T-plate 106 to the upper flange 104*b* of beam 104.

Figure 10:
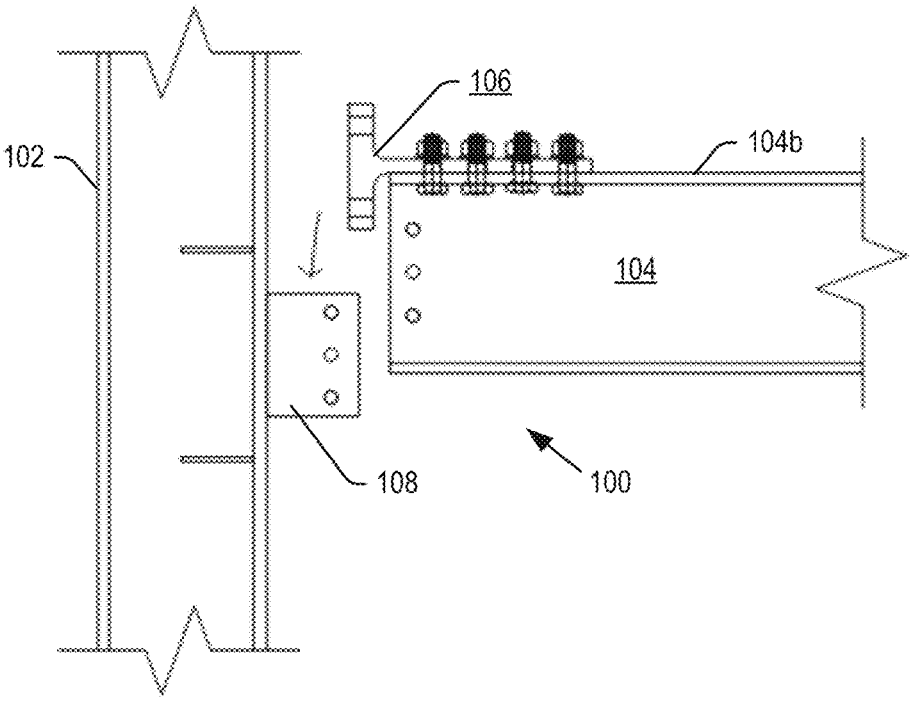
FIGS. 10 and 11 are side views showing a second method of assembling a beam onto a column according to embodiments of the present technology.
Figure 11:
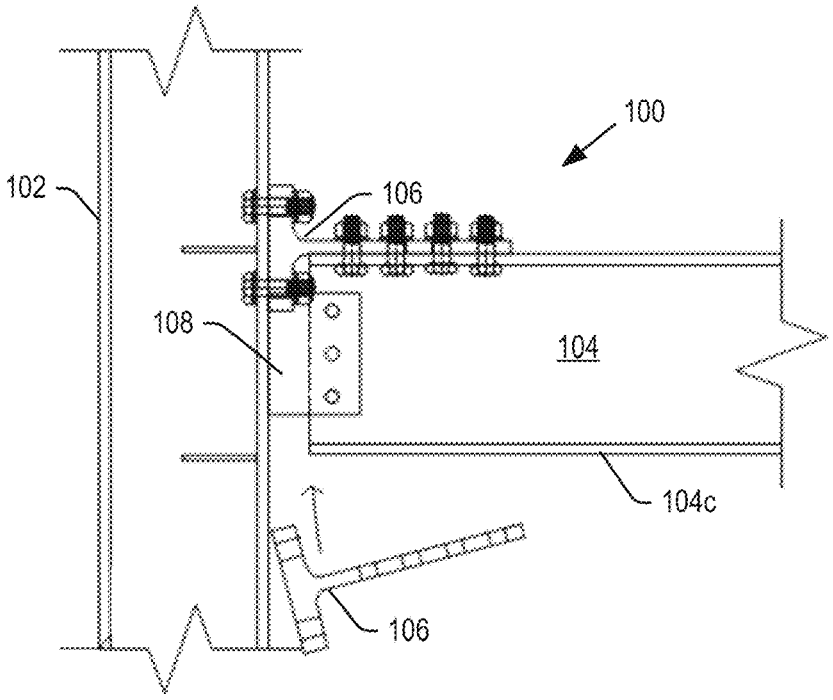

FIGS. 10 and 11 are side views of the moment frame and connector 100 showing an alternative method of assembly. The column 102 may be shipped to a construction site with the shear tab 108 affixed thereto as described above. The upper T-plate 106 may be affixed to the top flange 104*b* of beam 104 either at the construction site or before arrival at the construction site. As shown in FIG. 10, the beam 104 may then be lowered into position from above the shear tab 108. The notch 110 in the upper T-plate 106 functions to position the beam 104 centered with respect to column 102 and shear tab 108. The leading edge 110*a* of notch 110 serves to correct any misalignment. The vertical plate 106*a* of the upper T-plate 106 may then be bolted to the inner flange 102*b* of column 102, and the shear tab 108 may be bolted to the web 104*a* of the column 104.

Thereafter, as shown in FIG. 11, the lower T-plate 106 may then be positioned, using the leading edges 110*a* of notch 110 to properly position the T-plate 106. The lower T-plate 106 may then be affixed by bolting the vertical plate 106*a* of the lower T-plate 106 to the inner flange 102*b* of column 102, and bolting the horizontal plate 106*b* of the lower T-plate 106 to the lower flange 104*c* of beam 104. The column 102, beam 104, T-plates 106 and shear tab 108 may be affixed to each other by other methods in further embodiments.

Figure 12:
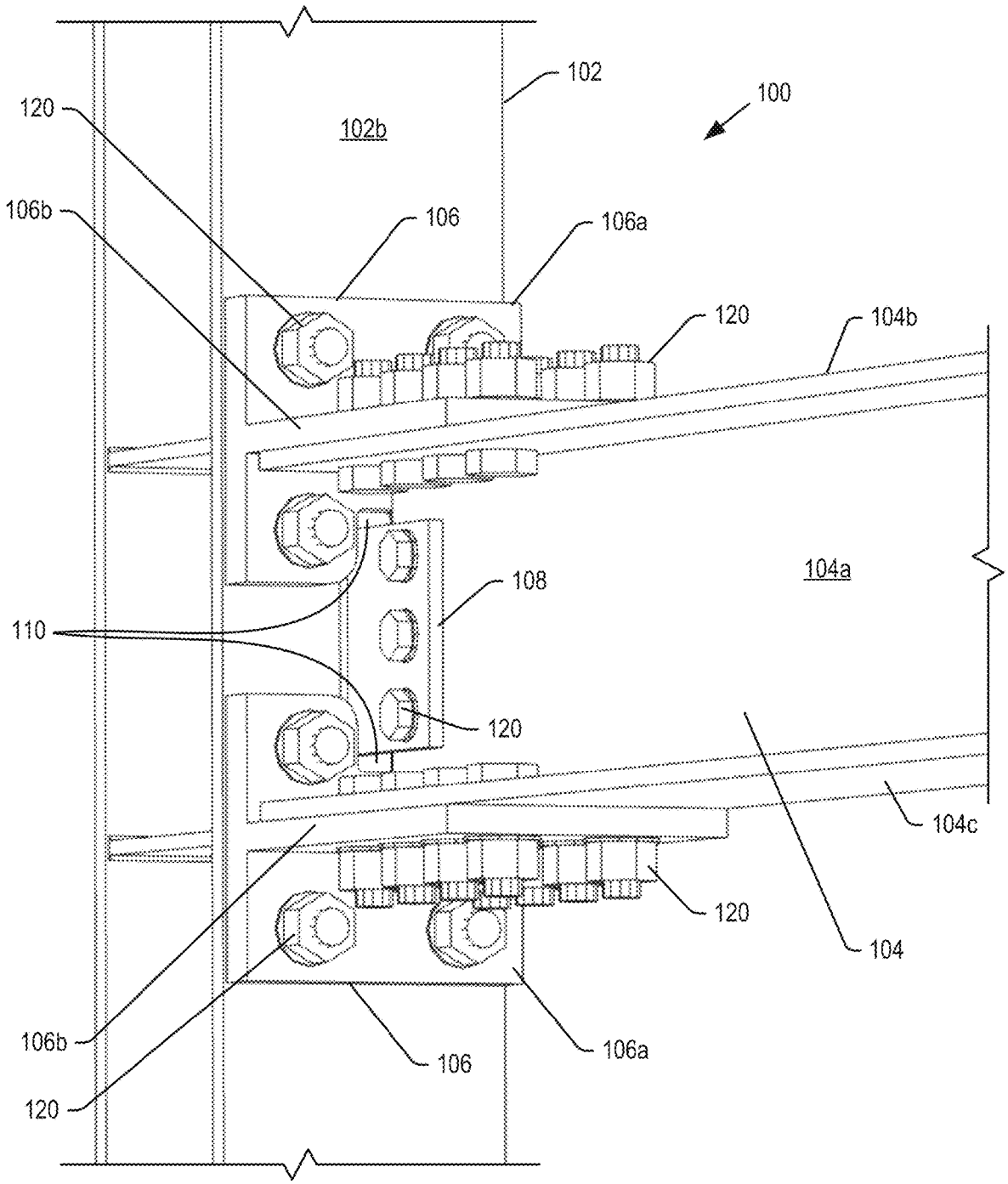
FIG. 12 is a perspective view of a moment frame connection including a pair of T-plates according to an embodiment of the present technology.

FIG. 12 is a perspective view showing the moment frame connector 100 including beam 104 completely assembled to column 102 by the upper and lower T-plates 106 and the shear tab 108. As seen, the moment frame connector 100 is assembled so that the upper and lower edges of the shear tab 108 fit within the notches 110 of the upper and lower T-plates 106. Nut and bolt fasteners 120 are shown as fitting through the bolt holes 112 of the vertical plate 106*a* and through the bolt holes 114 of the horizontal plate 106*b* in both the upper and lower T-plates 106. Nut and bolt fasteners 120 are also shown through sheer plate 108. The nuts and bolts used in fasteners 120 may for example have 1 inch to 1.5 inch diameters, but these dimensions may vary in different embodiments. The nut and bolt fasteners 120 used to fasten the vertical plates 106*a*, horizontal plates 106*b* and shear tab 108 may have the same or different dimensions.

Figure 13:
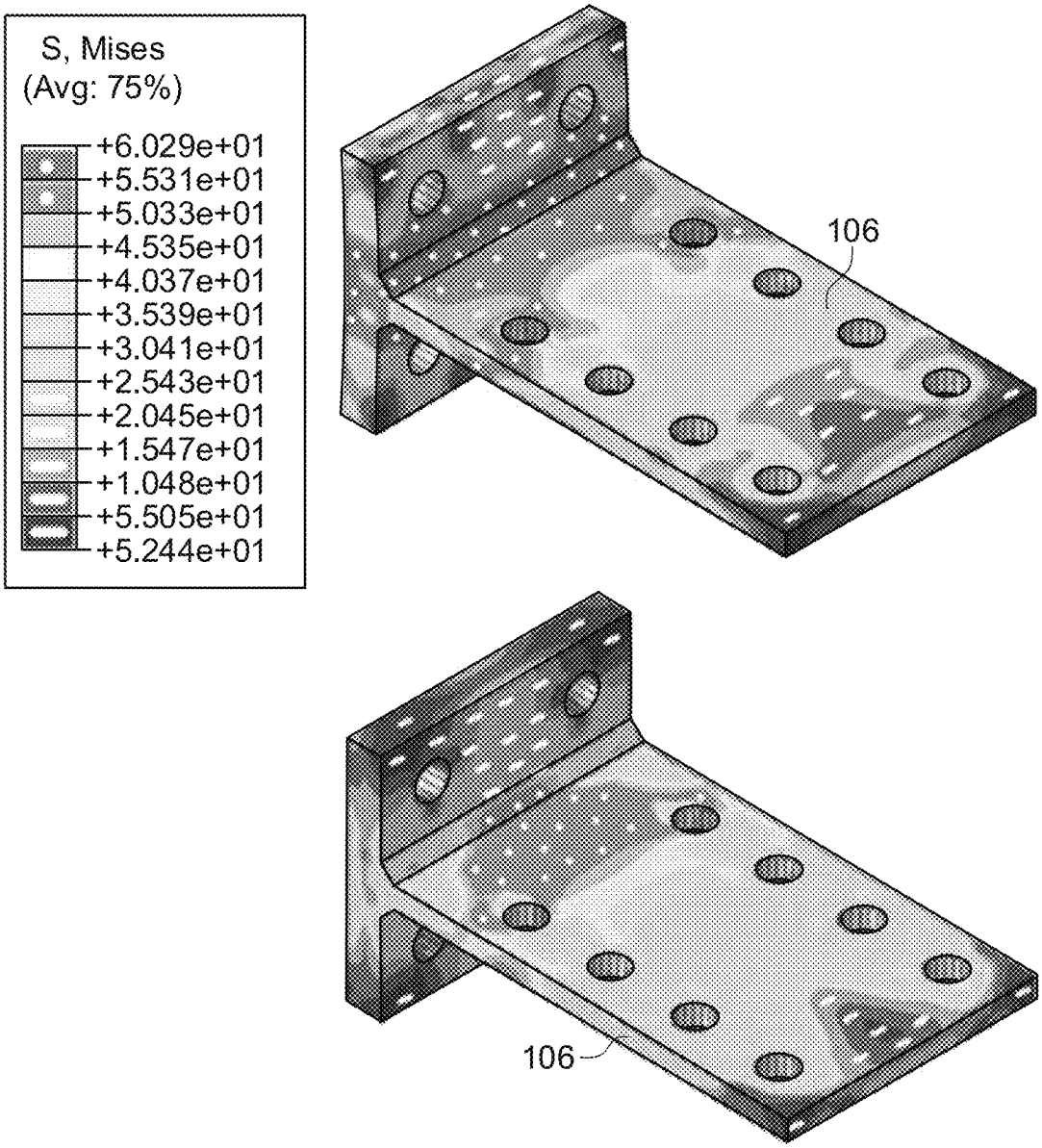
FIG. 13 is an illustration of stress distribution on a T-plate using finite element analysis according to an embodiment of the present technology.

It has been determined through finite element analysis (FEA) that the notches 110 may be formed in the vertical plates 106*a* of the T-plates 106 without sacrificing the strength or thickness of the T-plates 106. FIG. 13 shows an FEA analysis of the stresses on the upper and lower T-plates 106 when in position on column 102 and beam 104 and under a lateral load. As can be seen, the high stress areas (including dots) are concentrated at the seam between the vertical plate 106*a* and the horizontal plate 106*b* and at some of the screw holes 112, 114. The portions of the T-plates 106 to include the notch 110 are in low stress areas (including dashes). Thus, removal of material from the T-plates 106 in the area of the notches 110 does not meaningfully impact the structural integrity of the T-plates 106.

The length and width of the notches 110 may vary depending at least in part on the dimensions of the T-plates 106, shear tab 108 and nut and bolt fasteners 120. In one example, the T-plate 106 may have a width of 8 inches, and the vertical plate 106*a* may extend 4 inches above and below the horizontal plate 106*b*. The bolt holes 112 in the vertical plate 106*a* in this example may be centered across the width of the T-plate and spaced apart from each other 5 inches. In this example, the notch 110 may have a width (between the bolt holes 112) of 2 inches and a height of 2 inches. It is understood that these dimensions are by of example only and may vary in further embodiments, proportionately and disproportionately to the dimensions of the vertical plate 106*a* of T-plate 106.

The T-plates 106 having the notches 110 according to embodiments of the present technology provide a few advantages. For example, the notches 110 allow T-plates 106 with vertical plates 106*a* that are thick and/or long, shear tabs 108 which are thick and/long and nut and bolt fasteners 120 of large diameter, all of which without interference between the T-plate, shear tab and nut and bolt fasteners. Enlarging some or all of these components allows the moment frame connector system of the present technology to be sufficiently strong and stiff to be used in constructions in high wind areas or for structures otherwise requiring strong resistance to large lateral loads. This may also be accomplished using standard sized columns and beams.

Another advantage of the present technology is that the notches 110 allow a variety of different sized components (including the T-plates 106, shear tabs 108 and/or nut and bolt fasteners 120) to be used with standard sized columns and beams so that the moment frame connector 100 may be adapted for use in a variety of different lateral load scenarios.

A further advantage of the present technology is that the notches 110 allow a single size T-plate to be used with different sizes and types of shear tabs 108 and/or nut and bolt fasteners 120, based for example on varied lateral load requirements of the moment frame connector. This increases the flexibility of the structural engineer when designing a moment frame connector for different lateral loads. Another example is that the notches act as guides when assembling the beam 104 to the column 106, thereby making assembly quicker and easier at the construction site.

In addition to allowing for longer, thicker T-plates and/or shear tabs, the notches also allow for larger nut and bolt fasteners 120 to be used. With typical moment connectors, the diameter of bolt used to connect each of the upper and lower connectors to the column is limited by the space required for shear tab connections. This in turn limits the capacity that can be achieved for a particular beam depth. The notches 110 allow for larger diameter bolts to be used in the connection without intruding on the space needed to attach the shear tab 108 to the column 102. Higher capacities and stiffnesses can therefore be achieved using the present technology. This also eliminates the need to cope the beam which can be costly and labor intensive.

Figure 14:
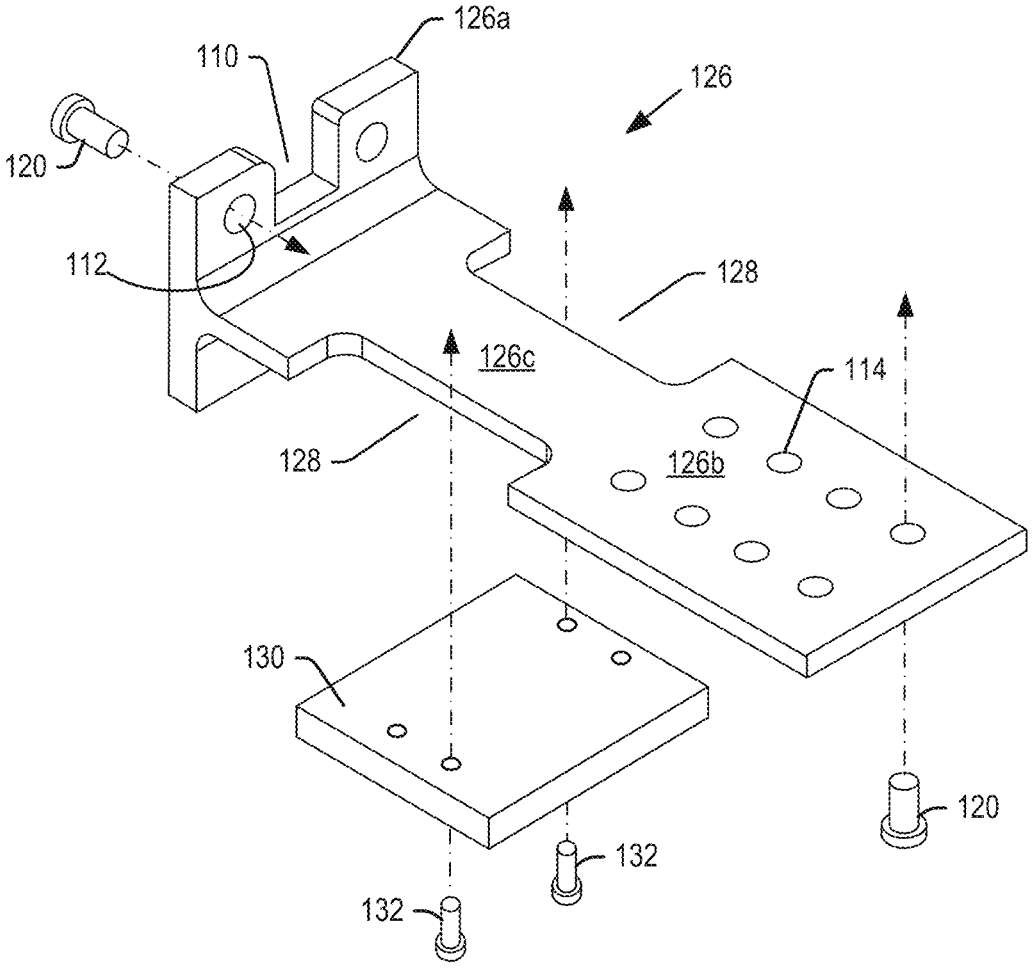
FIG. 14 is a perspective view of a hysteretic damping T-plate according to alternative embodiments of the present technology.

In embodiments described above, the T-plates have a constant cross-sectional width making them strong and stiff, and ideal to resist yielding in the lateral loads encountered in high wind areas. In further embodiments, the T-plates may alternatively be provided with a mechanical fuse designed to yield to provide hysteretic damping in the lateral loads encountered in seismic activity areas. Such an embodiment will now be described with reference to the hysteretic damping T-plate 126 shown in the perspective view of FIG. 14. In general, T-plate 126 may be identical to T-plate 106 except as noted below. The T-plate 126 includes a vertical plate 126*a* which is identical to vertical plate 106*a*, and a horizontal plate 126*b* which is identical to horizontal plate 106*b* except for the inclusion of notches 128 along the length of the horizontal plate 126*b*. These notches 128 define a fuse section 126*c* designed to yield in lateral loads above some predefined threshold. Thus, while T-plates 106 are designed to withstand high winds and other loads without deformation, the hysteretic damping T-plates 126 are designed to yield at thresholds below the loads they encounter. While this requires replacing the T-plates 126 upon such yielding, such yielding absorbs the energy of the lateral loads to prevent damage to the beam, column and other structures of the building. It is understood that the horizontal plates of the T-plate may have other shapes in further embodiments, including for example trapezoidal.

The vertical plates 126*a* and horizontal plates 126*b* of T-plates 126 may be affixed to the column 102 and beam 104 using nut and bolt fasteners 120 as described above. As is known, buckling restraint plates 130 may be bolted to the upper and lower flanges 104*b*, 104*c* of beam 104 using nut and bolt fasteners 132 to sandwich the horizontal plates 126*b* between the buckling restraint plates and the beam flanges. The hysteretic damping T-plates 126 may be used in any of the embodiments described above and below with respect to T-plates 106.

Figure 15:
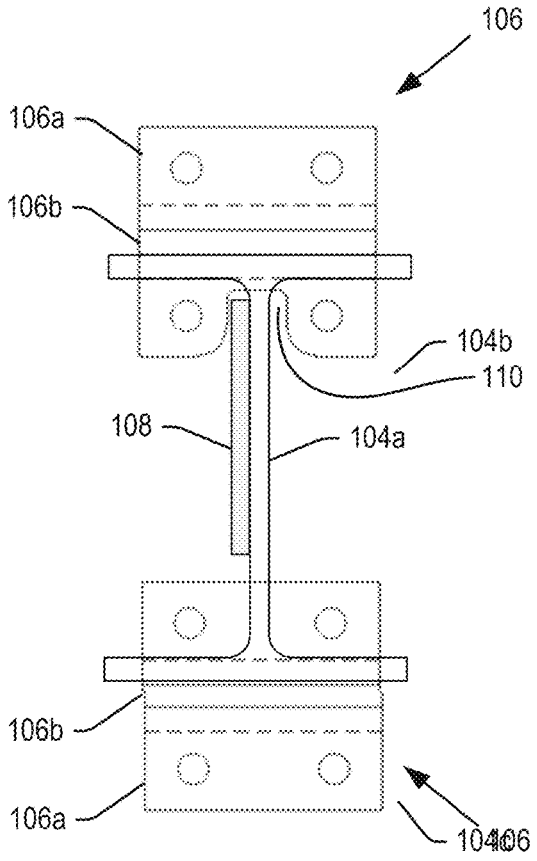
FIGS. 15-17 are edge views of three T-plates according to alternative embodiments of the present technology.
Figure 16:
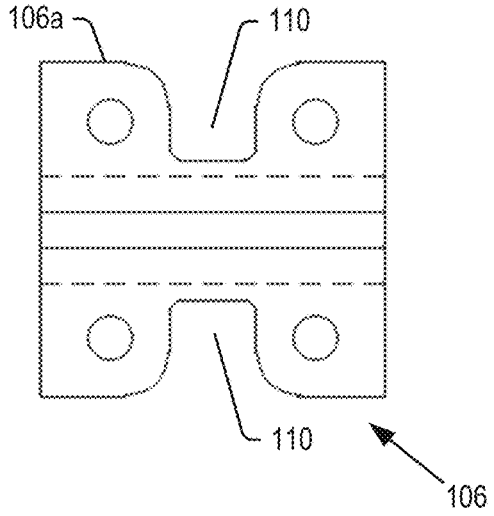

The edge views of FIGS. 15-17 show alternative embodiments of T-plates 106. FIG. 15 shows an embodiment where only one of the T-plates 106 includes a notch 110. The other T-plate is a standard T-plate without a notch. As shown, the notch 110 of the upper T-plate 106 receives the shear tab 108 as described above. The shear tab 108 in this embodiment is spaced away from the lower T-plate 106 so that no notch 110 is needed. In further embodiments, the notch 110 may be provided in the bottom T-plate 106 but not the upper T-plate 106. FIG. 16 shows a further embodiment of a T-plate 106 including a pair of notches 110, one each in the upwardly extending portion of vertical plate 106*a*, and in the downwardly extending portion of vertical plate 106*a*. The advantage of this embodiment is that the T-plate shown may be used as either the upper or lower T-plate, and it is not possible to install the T-plate upside down so that the notch 110 is facing the wrong way. FIG. 17 shows an edge view of a T-plate 106 including a notch 110 having leading edges 110*a* which are sloped instead of curved.

Figure 3:
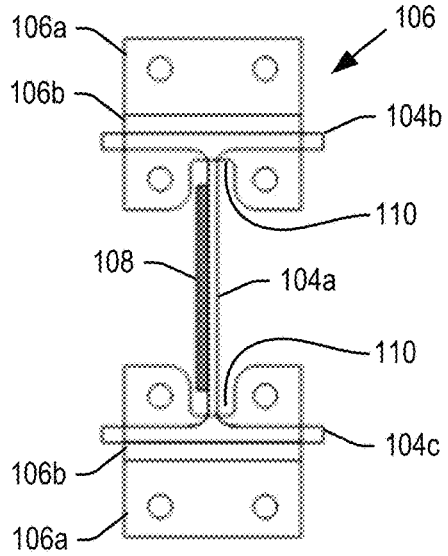
FIG. 3 is a cross-sectional end view through line A-A of FIG. 2 according to embodiments of the present technology.
Figure 18:
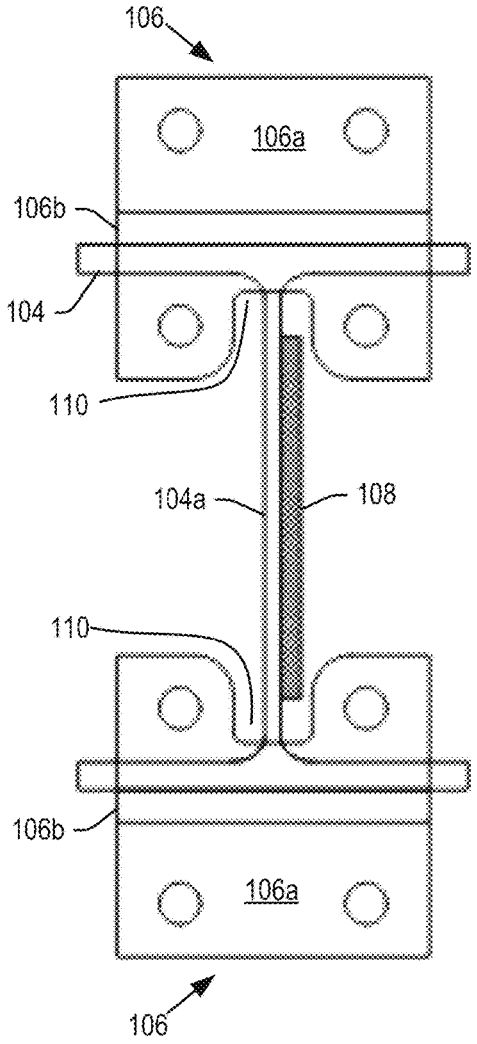
FIG. 18 is a cross-sectional edge view showing a pair of T-plates, a beam and a shear tab, with the shear tab on an opposite side of the beam web according to alternative embodiments of the present technology.
Figure 19:
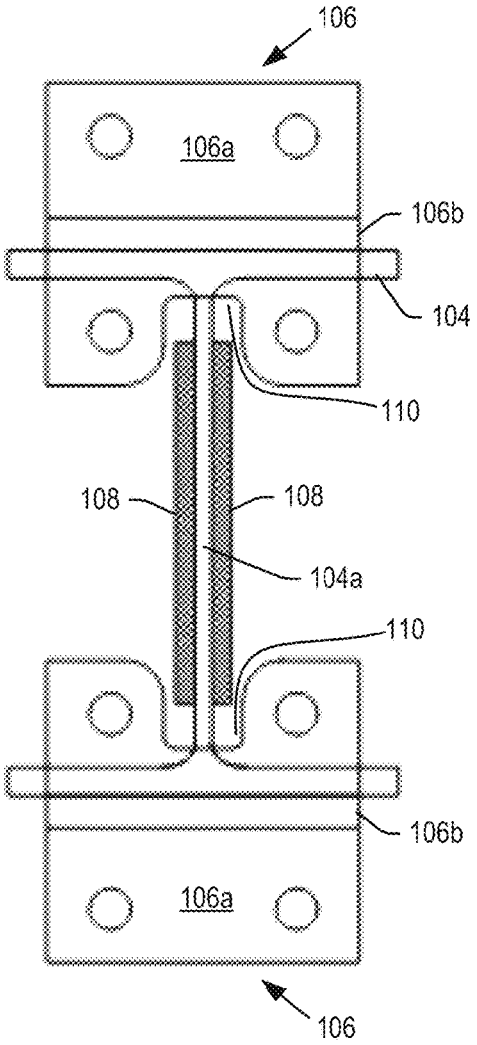
FIG. 19 is a cross-sectional edge view showing a pair of T-plates, a beam and a shear tab, with the shear tab on both first and second sides of the beam web according to alternative embodiments of the present technology.

As noted above, the notches 110 may be shaped to receive a variety of different shear tabs 108. FIGS. 18 and 19 illustrate two such further embodiments of shear tabs 108. In embodiments, the shear tab 108 may be mounted to either side of web 104*a*. FIG. 3 discussed above shows the shear tab 108 mounted on the left side of the web 104*a* of the beam 104. In FIG. 18, the shear tab 108 is mounted on the right side of web 104*a* of beam 104. FIG. 19 illustrates an embodiment including a double shear tab, where a first shear tab 108 is mounted to a first side of web 104*a*, and a second shear tab 108 is mounted to a second side of web 104*a*. In each of these embodiments, the notch 110 may be sized to receive shear tab(s) 108 without interference.

Figure 20:
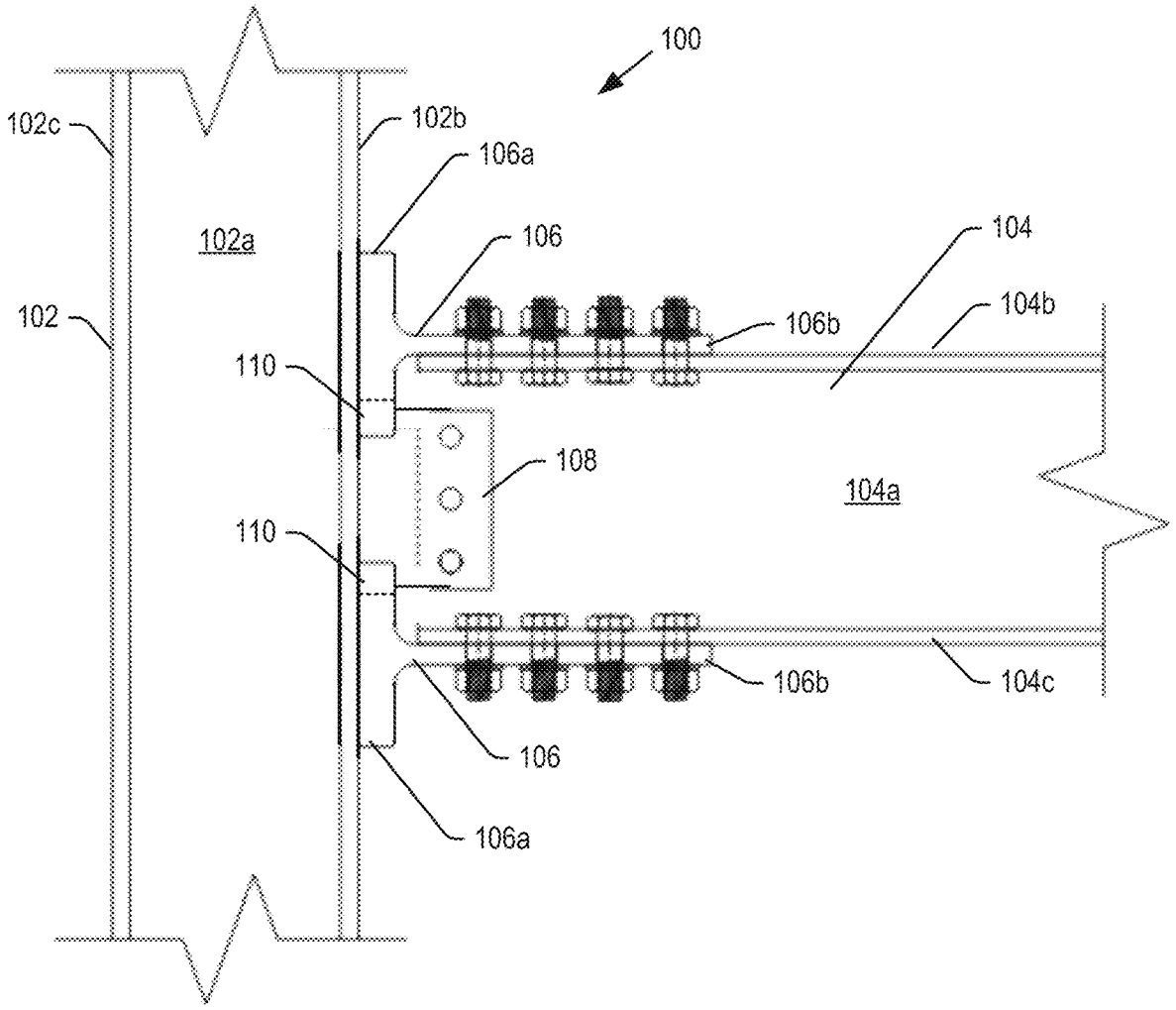
FIGS. 20-21 are side views showing welded T-plates according to alternative embodiments of the present technology.
Figure 21:
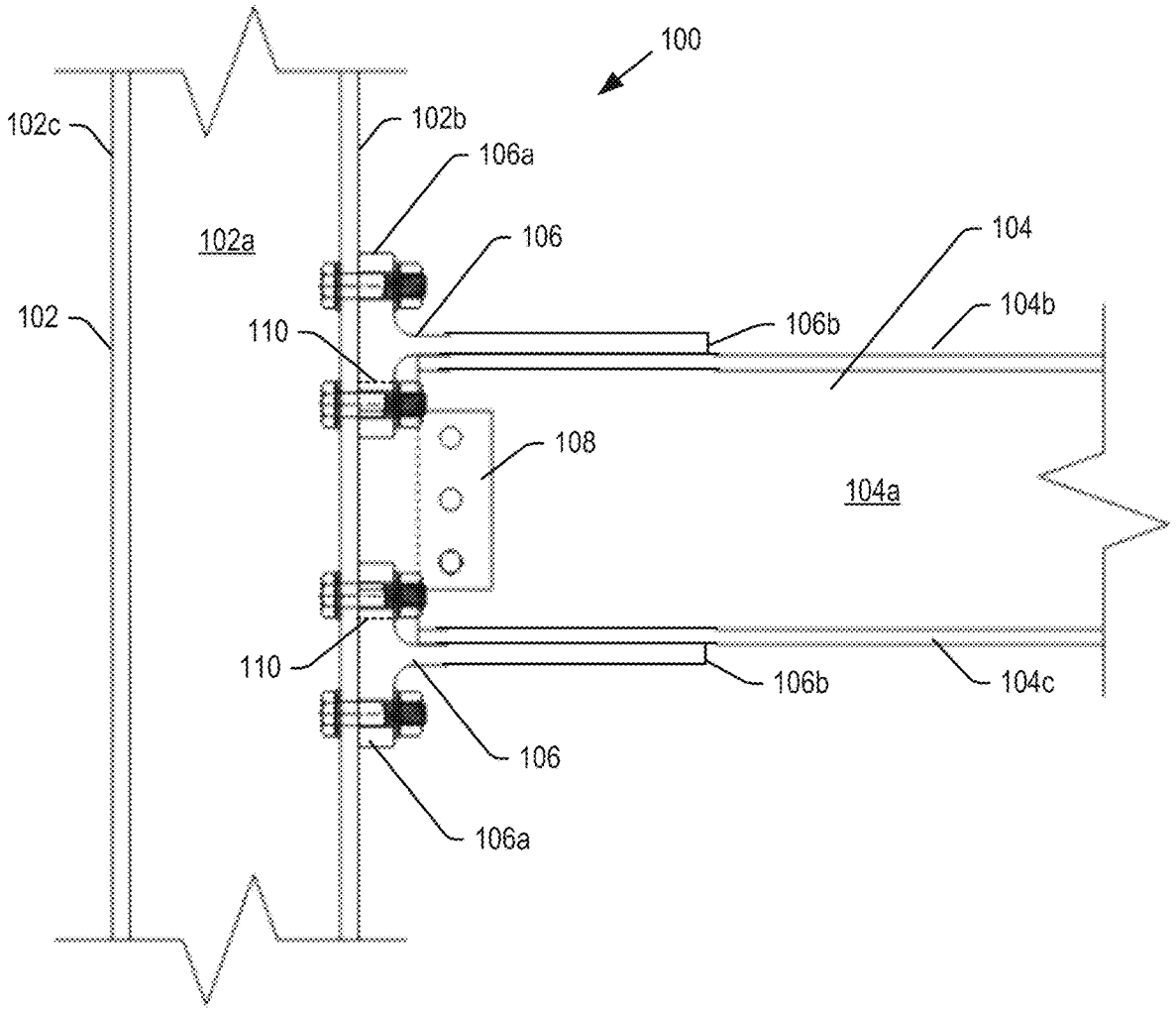

In embodiments described above, the T-plates 106 are bolted to the column 102 and beam 104. As noted, this provides advantages in minimizing welding in the field. However, it is understood that the T-plates 106 may be welded to the column and/or beam in further embodiments. FIG. 20 shows an embodiment where the T-plates 106 are affixed to the column 102 by welding and/or high-strength adhesive. Here, the column may have an I-shaped cross-section or may be HSS steel. In this embodiment, the notches 110 may be provided to prevent interference between the T-plates 106 and shear tab 108. FIG. 21 shows an embodiment where the T-plates 106 are affixed to the beam 104 by welding and/or high-strength adhesive. In this embodiment, the notches 110 may be provided to prevent interference between the T-plates 106, shear tab 108 and bolts. In a further embodiment, the T-plates 106 may be affixed to both the column 102 and beam 104 as by welding and/or high-strength adhesive.

Figure 22:
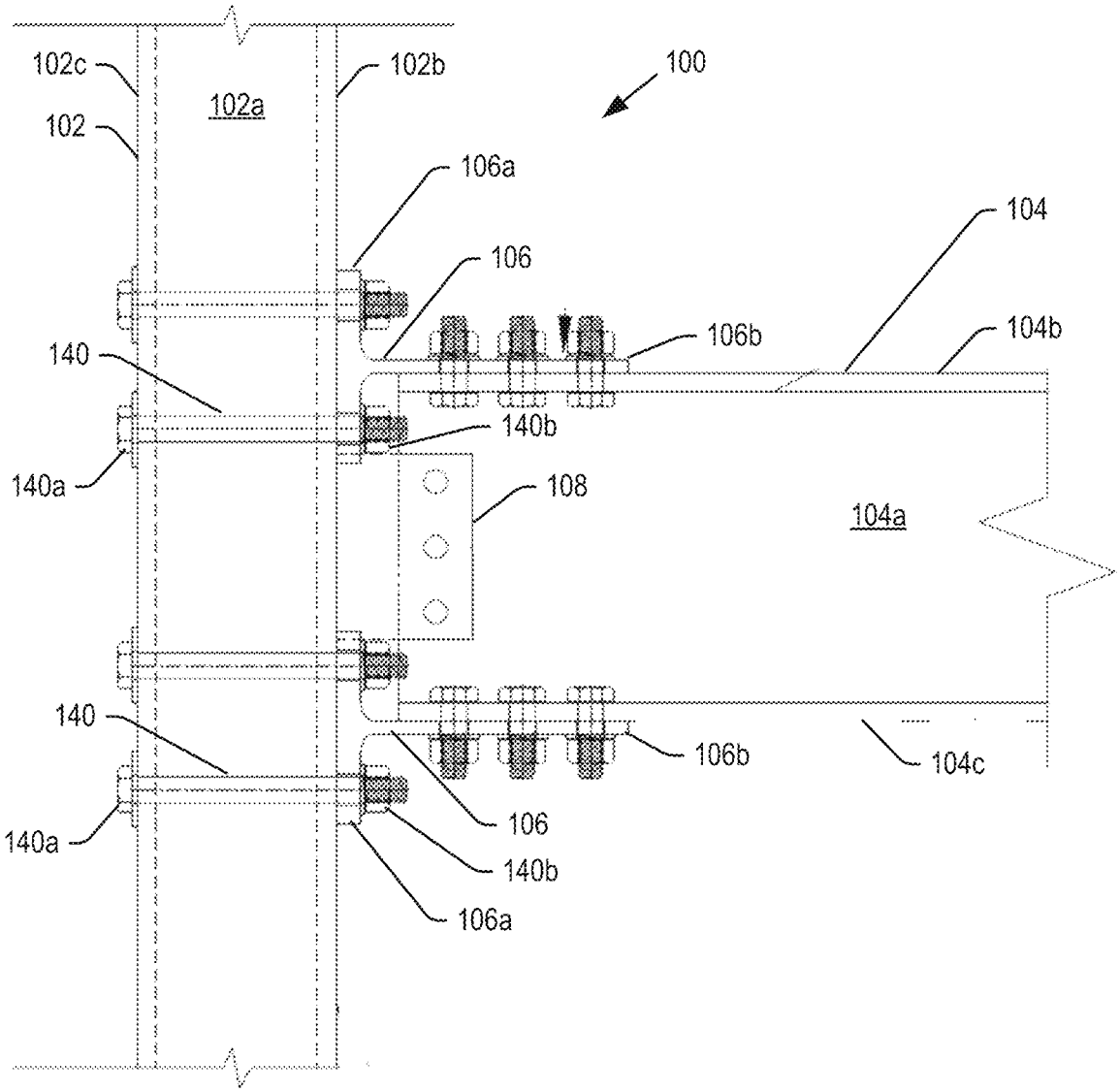
FIGS. 22-24 are side views showing systems for mounting the T-plates the column according to alternative embodiments of the present technology.
Figure 23:
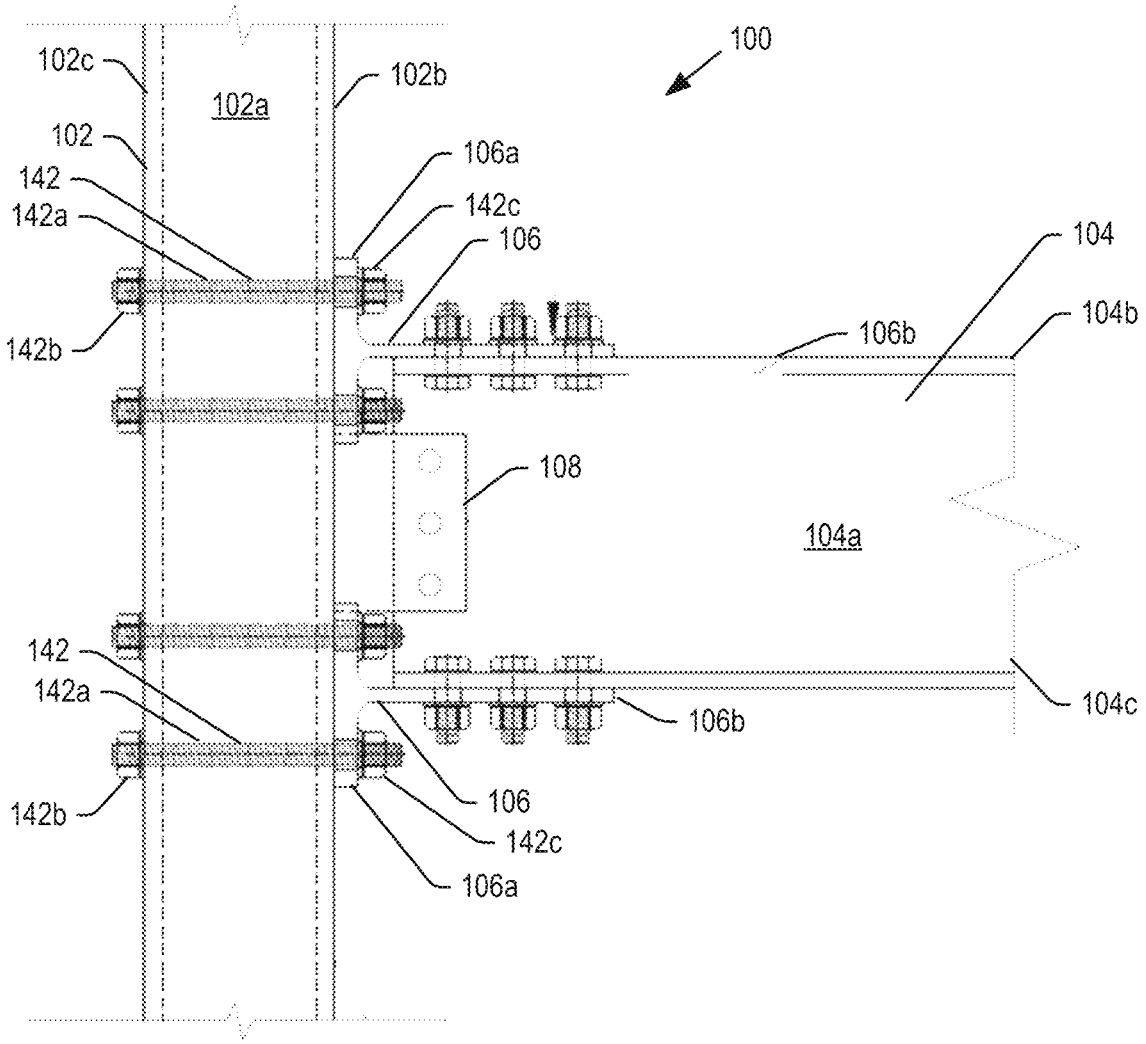
Figure 24:
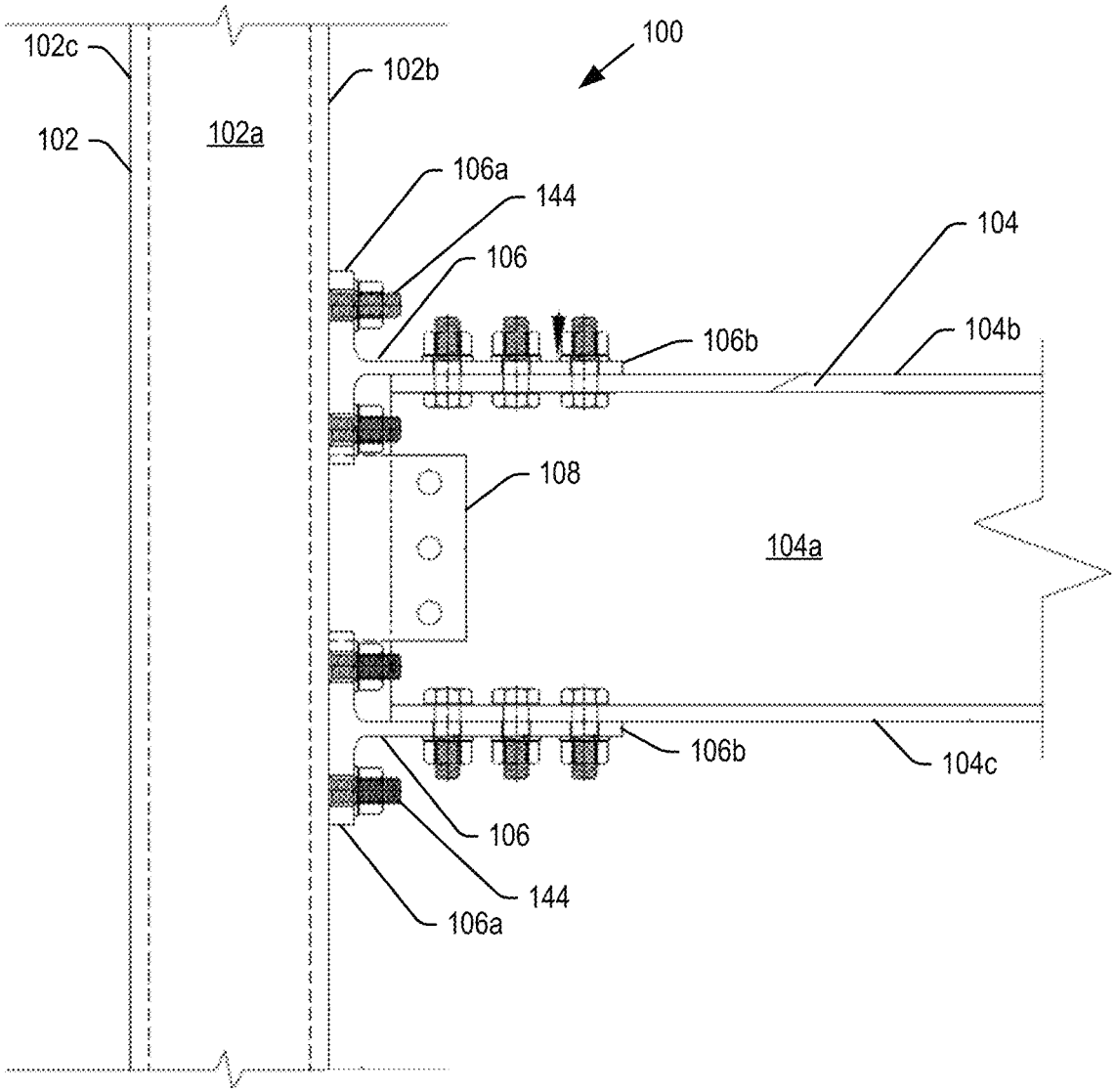

FIGS. 22-24 are side views showing further embodiments for affixing the T-plates 106 to column 102. Each of these embodiments may include a notch 110 (not labeled in FIGS. 22-24) according to any of the embodiments described herein. In FIG. 22, through-bolt fasteners 140 are used to affix the T-plates 106 to the column 102. As shown, the through-bolt fasteners 140 extend the depth of the column 102, so that a head 140*a* of the bolt is positioned against outer flange 102*c*, the bolt extends through the flange 102*b* and the T-plate vertical plate 106*a*, and receives a nut 140*b* against the vertical plate. Although not seen from the perspective of FIG. 22, there may be two such through-bolt fasteners 140 at each location (into the page of FIG. 22), one on either side of the web 102*a* of column 102.

In FIG. 23, threaded rod bolt fasteners 142 are used to affix the T-plates 106 to the column 102. As shown, the threaded rod bolt fasteners 142 include a threaded rod 142*a* that may extend the depth of the column 102, so that a first end of the threaded rod extends from outer flange 102*c* and receives a nut 142*b*, and a second end of the threaded rod extends from inner flange 102*b* and vertical plate 106*a* and receives a nut 142*c*. In further embodiments, the threaded rod 142 may extend only through the inner flange 102*b*. Although not seen from the perspective of FIG. 23, there may be two such threaded rod bolt fasteners 142 at each location (into the page of FIG. 22), one on either side of the web 102*a* of column 102.

In FIG. 24, threaded studs 144 are used to affix the T-plates 106 to the column 102. As shown, the threaded studs may be mounted to the flange 102*b* of column 102, for example by welding and/or a high-strength adhesive. The vertical plate 106*a* may be affixed over the threaded studs 144 and tightened using a nut. Although not seen from the perspective of FIG. 23, there may be two such threaded rod bolt fasteners 142 at each location (into the page of FIG. 22), one on either side of the web 102*a* of column 102. It is understood that at least some of the fasteners shown in FIGS. 22-24 may additionally or alternatively be used to affix the horizontal plates 102*b* of the T-plates to the beam flanges 104*b*, 104*c*.

In summary, embodiments of the present technology relate to a structural connector for a moment frame, comprising: a shear tab configured to mount to a first portion of the moment frame; a first plate configured to mount to a second portion of the moment frame; a second plate configured to mount to a third portion of the moment frame, the second plate extending from a portion of the first plate to divide the first plate into a first section and a second section; and a notch formed in the first or second sections of the first plate, the notch configured to receive an edge of the shear tab.

In another example, embodiments of the present technology relate to a structural connector for a moment frame including a column and a beam, the structural connector comprising: a shear tab configured to mount to the column and the beam; a first plate configured to mount to the column; bolt fasteners configured to mount the first plate to the column; a second plate configured to mount to the beam, the second plate extending from a portion of the first plate to divide the first plate into a first section and a second section; and a notch formed in the first or second sections of the first plate, the notch configured to prevent interference between one or more of the shear tab, the first plate and the bolt fasteners.

In a further example, embodiments of the present technology relate to a moment frame, comprising: a column; a beam comprising an upper flange and a lower flange; a structural connector configured to attach the beam to the column, the structural connector comprising: a shear tab configured to mount to the column and the beam; a first plate mounted to the column above the shear tab; a second plate mounted to the upper flange of the beam, the second plate extending from a portion of the first plate to divide the first plate into a first section and a second section, the first section facing downward toward the shear tab; and a notch formed in the first section of the first plate, the notch configured to prevent interference between the first plate and the shear tab.

The foregoing detailed description of the technology has been presented for purposes of illustration and description. It is not intended to be exhaustive or to limit the technology to the precise form disclosed. Many modifications and variations are possible in light of the above teaching. The described embodiments were chosen in order to best explain the principles of the technology and its practical application to thereby enable others skilled in the art to best utilize the technology in various embodiments and with various modifications as are suited to the particular use contemplated. It is intended that the scope of the technology be defined by the claims appended hereto.

What is claimed is:

1. A structural connector for a moment frame, comprising:

a shear tab configured to mount to a first portion of the moment frame;

a first plate configured to mount to a second portion of the moment frame;

a second plate configured to mount to a third portion of the moment frame, the second plate extending from a portion of the first plate to divide the first plate into a first section and a second section; and a notch formed in the first or second sections of the first plate, the notch configured to receive an edge of the shear tab.

2. The structural connector of claim 1, wherein the second plate extends orthogonally from the first plate.

3. The structural connector of claim 1, wherein the second plate is integrally formed with the first plate.

4. The structural connector of claim 1, wherein the first and second sections of the first plate are of equal lengths.

5. The structural connector of claim 1, further comprising rounded leading edges leading into the notch.

6. The structural connector of claim 1, further comprising sloped leading edges leading into the notch.

7. The structural connector of claim 1, further comprising bolt holes formed in the first and second sections of the first plate.

8. The structural connector of claim 7, where in the notch is formed between a pair of bolt holes in at least one of the first and second sections of the first plate.

9. The structural connector of claim 1, further comprising bolt holes formed in the second plate.

10. The structural connector of claim 1, wherein the first plate is configured to be affixed to the first portion of the moment frame by at least one of welding and high-strength adhesive.

11. The structural connector of claim 1, wherein the second plate is configured to be affixed to the second portion of the moment frame by at least one of welding and high-strength adhesive.

12. The structural connector of claim 1, wherein the second plate has a constant cross-sectional width along its length.

13. The structural connector of claim 1, wherein the second plate comprises a pair of notches to define a mechanical fuse configured to yield under loads above a predefined threshold.

14. The structural connector of claim 1, wherein the notch comprises a first notch in the first section of the second plate, the structural connector further comprising a second notch in the second section of the second plate.

15. The structural connector of claim 1, wherein the moment frame is part of a building.

16. The structural connector of claim 1, wherein the moment frame is part of a bridge.

17. A structural connector for a moment frame including a column and a beam, the structural connector comprising:

a shear tab configured to mount to the column and the beam;

a first plate configured to mount to the column;

bolt fasteners configured to mount the first plate to the column;

a second plate configured to mount to the beam, the second plate extending from a portion of the first plate to divide the first plate into a first section and a second section; and a notch formed in the first or second sections of the first plate, the notch configured to prevent interference between two or more of the shear tab, the first plate and the bolt fasteners.

18. The structural connector of claim 17, further comprising rounded leading edges leading into the notch.

19. The structural connector of claim 17, further comprising sloped leading edges leading into the notch.

20. The structural connector of claim 17, wherein the second plate has a constant cross-sectional width along its length.

21. The structural connector of claim 17, wherein the second plate comprises a pair of notches to define a mechanical fuse configured to yield under loads above a predefined threshold.

22. The structural connector of claim 17, wherein the notch comprises a first notch in the first section of the second plate, the structural connector further comprising a second notch in the second section of the second plate.

23. A moment frame, comprising:

a column;

a beam comprising an upper flange and a lower flange;

a structural connector configured to attach the beam to the column, the structural connector comprising:

a shear tab configured to mount to the column and the beam;

a first plate mounted to the column above the shear tab;

a second plate mounted to the upper flange of the beam, the second plate extending from a portion of the first plate to divide the first plate into a first section and a second section, the first section facing downward toward the shear tab; and a notch formed in the first section of the first plate, the notch configured to prevent interference between the first plate and the shear tab.

24. The moment frame of claim 23, wherein the structural connector comprises a first structural connector, the moment frame further comprising a second structural connector, the second structural connector comprising:

a third plate mounted to the column below the shear tab;

a fourth plate mounted to the lower flange of the beam, the fourth plate extending from a portion of the third plate to divide the third plate into a third section and a fourth section, the third section facing upward toward the shear tab; and a second notch formed in the third section of the third plate, the second notch configured to prevent interference between the third plate and the shear tab.

25. The moment frame of claim 24, wherein a first edge of the shear tab is positioned within the first notch.

26. The moment frame of claim 23, wherein a second edge of the shear tab, opposite the first edge, is positioned in the second notch.

27. The moment frame of claim 23, further comprising bolt fasteners fastening the first plate to the column.

28. The moment frame of claim 27, wherein the notch is configured to prevent interference between the bolt fasteners and the shear tab.

* * * * *